US011473324B2

(12) United States Patent
Capizzo

(10) Patent No.: US 11,473,324 B2
(45) Date of Patent: Oct. 18, 2022

(54) PROTECTIVE SLEEVE FOR A SWIMMING POOL COVER HOLD-DOWN WEIGHT WATER TUBE

(71) Applicant: Kevin Lawrence Capizzo, Sterling Heights, MI (US)

(72) Inventor: Kevin Lawrence Capizzo, Sterling Heights, MI (US)

( * ) Notice: Subject to any disclaimer, the term of this patent is extended or adjusted under 35 U.S.C. 154(b) by 407 days.

(21) Appl. No.: 16/541,554

(22) Filed: Aug. 15, 2019

(65) Prior Publication Data

US 2020/0056390 A1 Feb. 20, 2020

Related U.S. Application Data

(60) Provisional application No. 62/719,570, filed on Aug. 17, 2018.

(51) Int. Cl.

| | |
|---|---|
| ***E04H 4/10*** | (2006.01) |
| ***B65D 33/25*** | (2006.01) |
| ***B65D 33/16*** | (2006.01) |
| ***B65D 65/46*** | (2006.01) |

(52) U.S. Cl.

CPC ..... *E04H 4/10* (2013.01); *B65D 33/165* (2013.01); *B65D 33/2508* (2013.01); *B65D 65/466* (2013.01)

(58) Field of Classification Search

CPC .... E04H 4/10; B65D 33/165; B65D 33/2508; B65D 65/466

See application file for complete search history.

(56) References Cited

U.S. PATENT DOCUMENTS

| | | | | |
|---|---|---|---|---|
| 3,123,279 | A * | 3/1964 | Day | B65D 31/00 383/102 |
| 3,667,070 | A * | 6/1972 | Pitti | E04H 4/10 4/503 |
| 3,732,581 | A * | 5/1973 | Pitti | E04H 4/10 4/503 |
| 4,925,711 | A * | 5/1990 | Akao | B32B 27/08 428/35.2 |
| 5,020,175 | A * | 6/1991 | Kirkpatrick | A47C 15/006 206/430 |
| 5,199,793 | A * | 4/1993 | Jackson | B65D 88/16 220/905 |
| 6,626,570 | B2 * | 9/2003 | Fox | B65D 29/04 383/117 |
| 6,913,385 | B1 * | 7/2005 | Sagos | E04H 4/0018 383/23 |
| 8,888,406 | B2 * | 11/2014 | Keaton | E02B 3/127 405/16 |
| 2005/0066624 | A1 * | 3/2005 | Dextraze | B65B 31/06 53/399 |
| 2006/0124490 | A1 * | 6/2006 | Dufresne | B65D 85/67 206/410 |
| 2007/0140600 | A1 * | 6/2007 | Nowak | B31B 70/00 383/116 |
| 2010/0162478 | A1 * | 7/2010 | Olson | E04H 4/10 4/496 |

(Continued)

*Primary Examiner* — Christopher R Harmon

(57) ABSTRACT

A protective sleeve is disclosed herein consisting of a rectangular upper and lower panel with three edges of the panels permanently sealed together and at least one shorter edge unsealed to allow for full insertion and extraction by one person a swimming pool cover hold-down weight water tube and allows for airtight or non-airtight sealing of the unsealed end.

4 Claims, 5 Drawing Sheets

(56) References Cited

U.S. PATENT DOCUMENTS

| | | | | |
|---|---|---|---|---|
| 2011/0315582 | A1* | 12/2011 | Chow | B65B 53/063<br>206/410 |
| 2016/0362065 | A1* | 12/2016 | Dooling | B60R 9/065 |
| 2017/0253421 | A1* | 9/2017 | Pearce | B65B 63/04 |

* cited by examiner

PROTECTIVE SLEEVE FOR A SWIMMING POOL COVER HOLD-DOWN WEIGHT WATER TUBE

CROSS REFERENCE TO RELATED APPLICATIONS

This application claims the priority of Provisional Patent Application Ser. No. 62/719,570 filed Aug. 17, 2018 and entitled Swimming Pool Cover Hold-Down Weight Protective Covering.

BACKGROUND OF THE INVENTION

Field of the Invention

The present invention relates to water tube weights used for holding down swimming pool covers. To be more specific, this invention is a protective sleeve for the water tube weights.

Discussion of the State of the Art

Swimming pool covers are used to protect pools from dirt, debris and algae buildup when they are closed down for the season in regions with cold winters. These covers are usually large vinyl tarps that are draped over the pool and held in place by moderately heavy weights placed around the perimeter of an in-ground pool or an above ground pool surrounded by decking.

A common weight used for this purpose is a water bag, also known as a water tube because the water bags generally have a tubular shape. The water tubes are typically long slender vinyl tubes with a round resealable opening at one end for insertion of a garden hose in order to fill the tube with water, giving the tube the required weight needed to hold-down and keep the pool cover in place. The water tubes are typically a single or double longitudinal chamber configuration in lengths of usually eight to ten feet. Typically, ten to twenty water tubes are placed end to end around the perimeter of the pool cover to provide the distributed weight needed to hold-down the cover against strong winds or any other outdoor conditions that would cause the cover to move away from its intended placement. The pool cover also accumulates rain and snow on its top surface that would cause the cover to drop down into the pool. The filled water tubes placed around the perimeter of the cover keeps the cover from dropping down into the pool as well.

These vinyl water tubes have proven over time to be a very popular means of providing a pool cover hold-down weight because they can be easily folded when empty and take up very little space when stored. They are also very flexible allowing for conformance to the perimeter of an oval, circular or any free-form shaped pool.

The filled water tubes have a low profile and are very resistant to moving when exposed to high winds. The water tubes generally come in lengths of eight to ten feet which allows for fewer of them being required as opposed to using sand bags or other types of shorter length weights. The water tubes also offer a relatively inexpensive solution to providing a sufficient cover weight compared to other types of weights available for this purpose.

However, the water tubes tend to become very dirty and stained from being openly exposed to the outdoor environment for a long period of months at a time. Therefore, when the pool is opened for the season and the winter cover and water tubes are removed, the water tubes require a thorough cleaning and then need to be allowed to dry before they are folded and stored for the next use. This cleaning process can be extremely difficult and laborious because it requires intense scrubbing and rinsing of multiple water tubes in typically hot sunny weather when pools are usually opened for the season.

Another negative issue with the water tubes is they are usually made of thin vinyl material that is easily torn or punctured, therefore, they must be replaced fairly often. Also, the water tubes are typically not made from biodegradable materials, and if not recycled properly, will add unrecycled, non-biodegradable waste to the environment.

Therefore, what is clearly needed is an easy to use, economical, outdoor weather resistant and environmentally friendly water tube protective sleeve that solves the problems mentioned above.

SUMMARY OF THE INVENTION

In one embodiment of the invention is a protective sleeve consisting of a rectangular upper and lower panel with three edges of the panels permanently sealed together and at least one shorter edge unsealed to allow for full insertion and removal, by one person, a swimming pool cover hold-down weight water tube and allows for airtight or non-airtight sealing of the unsealed end.

Also in one embodiment the protective sleeve comprises of an upper and lower panel with dimensions that are approximately five to forty percent wider and four to twenty-five percent longer than current swimming pool cover hold-down weight water tubes.

Also in one embodiment the protective sleeve comprises of an upper and lower panel made from low density polyethylene or any low cost, recyclable or biodegradable material that is water proof, ultraviolet light resistant, and outdoor weather resistant with a thickness of each panel ranging from approximately 0.0005 to 0.006 inches and can be any color or is translucent or transparent. The upper and lower panels can be air permeable or non-air permeable.

Also in one embodiment the protective sleeve comprises of at least one unsealed shorter edge that allows for airtight or non-airtight sealing of the unsealed end by way of a cable tie, press-to-close zipper, or any type of closure device known in the art of sleeve or bag closures.

BRIEF DESCRIPTION OF THE DRAWINGS

For a more complete understanding of the invention, reference should now be made to the embodiments illustrated in greater detail in the accompanying drawings and described below by way of an example of the invention.

In the drawings.

DETAILED DESCRIPTION OF THE INVENTION

The inventor provides a unique protective sleeve for protecting a swimming pool cover water tube weight commonly used to hold down the cover. The application of the protective sleeve can be achieved by one person. The present invention is described in enabling detail in the following examples, which may represent more than one embodiment of the present invention.

Figure 1:
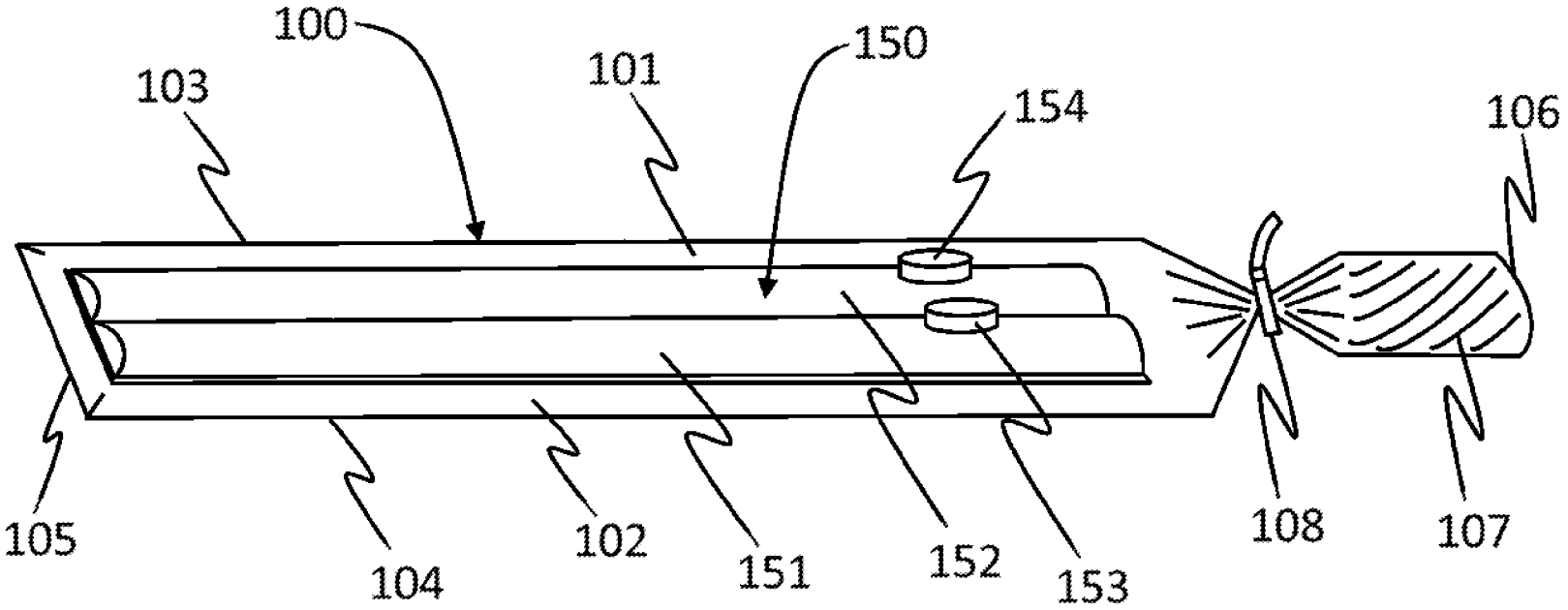
FIG. 1 shows a perspective view of a swimming pool cover water tube weight inserted into a protective sleeve with a cable tie closure.

FIG. 1 is a perspective view showing a typical swimming pool cover hold-down weight water tube 150 which can be referred to as simply the water tube. In this embodiment, a typical commercially available water tube comprises of two vinyl chambers 151 and 152 which are permanently connected along the center of the water tube as shown in the figure. In this example, each vinyl chamber 151 and 152 has dimensions of approximately five inches wide by eight feet long, giving the water tube overall dimensions of approximately ten inches wide by eight feet long. Vinyl chambers 151 and 152 each come with an opening at one end 153 and 154 where a garden hose is inserted in order to fill each chamber with water. The openings 153 and 154 each come with an attached cap that the user simply pulls out to open or pushes in to close the openings. When vinyl chambers 151 and 152 are filled with water, the water tube 150 will weigh in the range of forty to fifty pounds, giving it the sufficient weight needed to hold down a swimming pool cover when multiple water tubes are placed end to end around the perimeter of the cover.

In another example, the water tube could be a single chamber design with only one opening for garden hose insertion. Both single and double chamber water tubes typically come in lengths of eight to ten feet with varying widths in the range of eight to twelve inches.

A protective sleeve 100 consists of an upper panel 101 and matching lower panel 102. Both panels are water proof, ultraviolet light (UV) resistant and outdoor weather resistant. In FIG. 1, upper panel 101 is laying on top of lower panel 102 as the protective sleeve 100 and the inserted water tube 150 are lying on the ground. Three edges of the panels 103, 104 and 105 are permanently sealed together and at least one shorter edge 106 is unsealed to allow for full insertion and extraction by one person a water tube 150. After water tube 150 is inserted, unsealed edge 106 can be sealed by any means discussed later.

One person can easily apply and remove protective sleeve 100. Based on prototype testing of various sizes of the protective sleeve, the rectangular upper panel 101 and matching rectangular lower panel 102 should be in the range of approximately five to forty percent wider, and four to twenty-five percent longer than current commercially available water tubes. The length of the protective sleeve will depend on the type of sealing device used on unsealed shorter edge 106.

In order for the protective sleeve 100 to provide useful protection of the water tube 150 against punctures and tears, based on prototype testing, each of the rectangular panels 101 and 102 should have a thickness in the range of approximately 0.0005 to 0.006 inches, depending on the toughness of the material used.

In order for the protective sleeve 100 to be as low cost as possible, each of the rectangular panels 101 and 102 can be made from standard low density polyethylene material without any special hot/cold temperature or UV protective additives.

Based on prototype testing of the protective sleeve 100, standard low density polyethylene without any special hot/cold temperature or UV protection additives will hold up to hot/cold outdoor weather and simultaneous sunlight UV exposure without tearing or deteriorating and will remain intact for at least one year of use. Standard low density polyethylene is not normally rated for long term use in below freezing temperatures or constant UV exposure. The acceptable use of this material for upper panel 101 and lower panel 102 is not readily apparent without testing for this specific application as the inventor has done. Standard low density polyethylene is also very easy to recycle.

In another example, upper panel 101 and lower panel 102 could be made from any low cost, water proof, UV and outdoor weather resistant material as long as it has been proven to provide the intended protection of water tube 150 for at least one year in any geographic region where the water tubes might be used.

Since it's the intention of protective sleeve 100 to be discarded and recycled after one season, or one year of use, in a further embodiment of the invention, it is contemplated rectangular upper panel 101 and matching rectangular lower panel 102 can made from any low cost, recyclable, biodegradable, or other eco-friendly material as long as it's water proof, UV and outdoor weather resistant and is tear and puncture resistant. The protective sleeves could be used for more than one season depending on their condition and the discretion of the user.

Regardless of what size, thickness or material panels 101 and 102 are made of, the material could be any color or could be translucent or transparent.

In order to allow for evaporation of any internal condensation that could build-up within the protective sleeve 100, a very small amount of air should be allowed to pass into and out of the sleeve. Therefore, panels 101 and 102 of the protective sleeve 100 can be made from a material that is water-proof but is also air permeable.

In another embodiment, if panels 101 and 102 of the protective sleeve 100 are made from material that is water-proof and non-air permeable, unsealed end 106 can be sealed after the insertion of water tube 150 by a cable tie 108. Cable tie 108 will provide a simple and cost effective means for sealing the unsealed end 106 against water, dirt and debris from entering the sleeve but will still allow for a small amount of air to pass through needed for evaporation. If a cable tie is used, panels 101 and 102 could be made around twenty-five percent longer than water tube 150 in order to provide extra material that would be twisted clockwise by the user three or four times in order to better accommodate installation of the cable tie. The twisted material is indicated by curved lines 107. The extra-length twisted material can be folded back under the water tube for better overall appearance and compactness after the cable tie is installed.

In one example, based on prototype testing of the protective sleeve 100 and cable tie 108, the cable tie could be a standard off-the-shelf electrical cable tie six inches in length because such a cable tie proved to maintain its strength and functionality used outdoors for at least one year in a cold weather climate. In another embodiment, the means for sealing the unsealed end 106 could be any device known in the art of sleeve or bag closures that allows for airtight or non-airtight sealing of the unsealed end.

Figure 2:
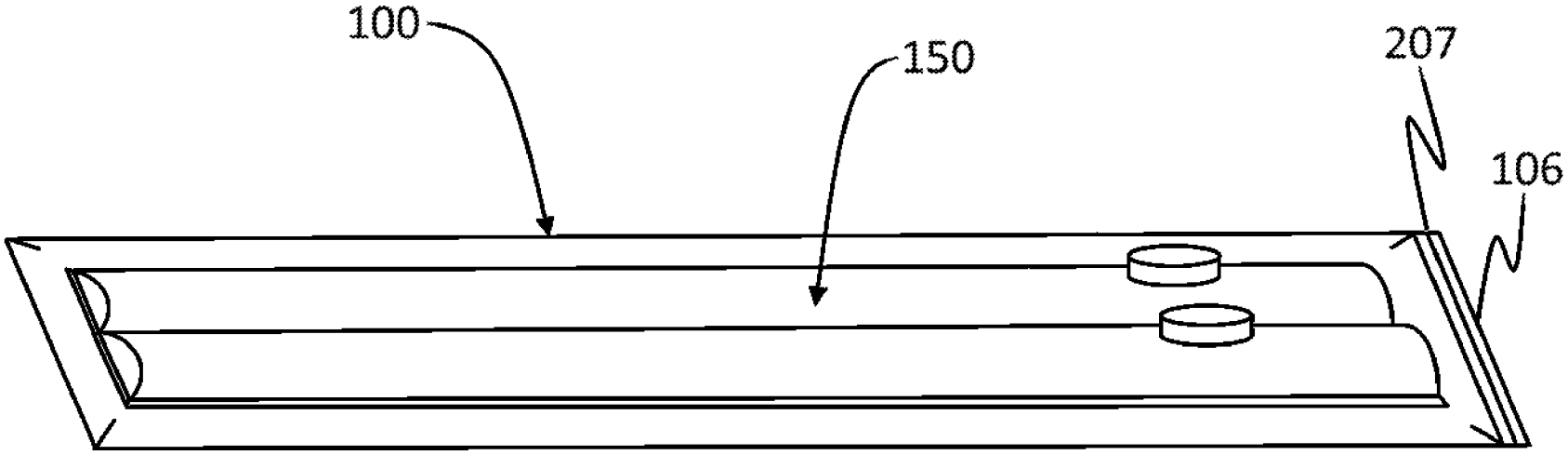
FIG. 2 shows a perspective view of a swimming pool cover water tube weight inserted into a protective sleeve with a press-to-close zipper sealing apparatus.

FIG. 2 is a perspective view of another embodiment of the present invention. This embodiment includes components that were previously introduced in FIG. 1. Those components previously introduced that have not changed in this example retain their original element numbers and are not re-introduced. In this example, unsealed end 106 shows a means for being sealed after water tube 150 has been inserted that includes a press-to-close zipper type of sealing apparatus 207. This image of embodiment of protective sleeve 100 will be used in the remaining figures, but is not meant to be the only embodiment possible in the remaining figures.

Figure 3:
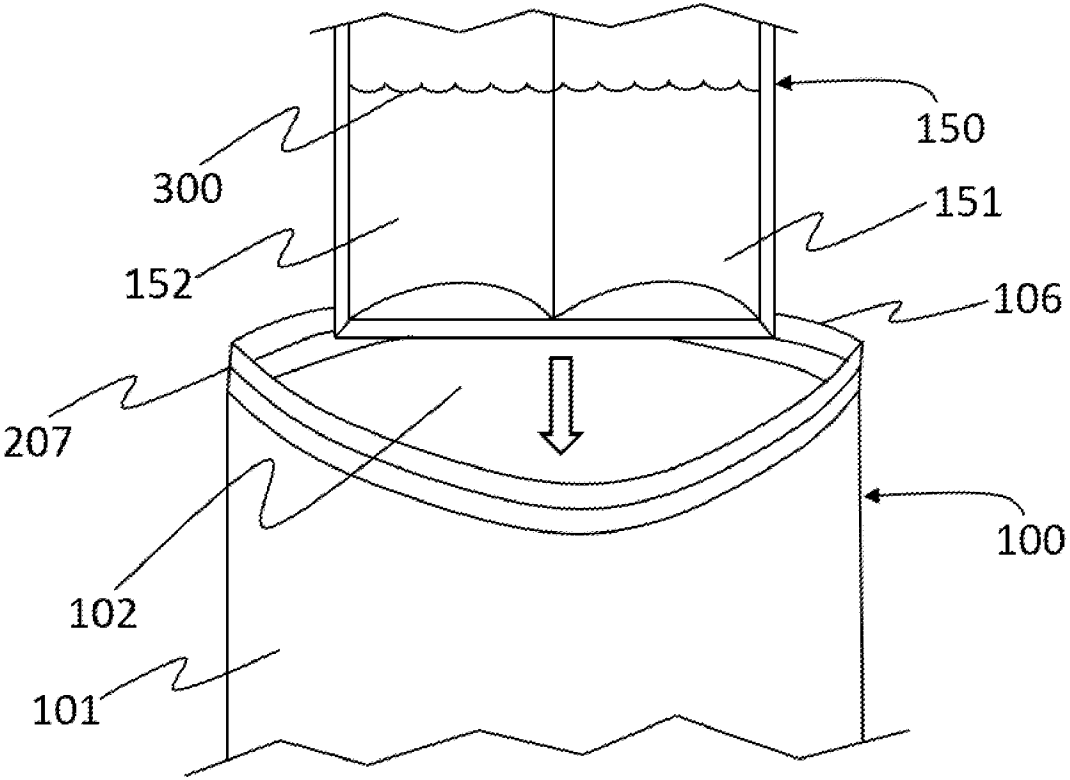
FIG. 3 shows a perspective view of a swimming pool cover water tube weight being inserted into a protective sleeve.

FIG. 3 is a perspective view showing an insertion method of water tube 150 into protective sleeve 100. This figure includes components that were previously introduced in FIG. 1 and FIG. 2. Those components previously introduced that have not changed in this example retain their original element numbers and are not re-introduced. In FIG. 3, both the protective sleeve 100 and water tube 150 are pictorially truncated in order to show only the details needed to illustrate an insertion method.

Based on prototype testing of protective sleeve 100, a method is shown how full insertion of water tube 150 into the protective sleeve can be accomplished by one person. The usefulness of the invention is dependent on the ability of one person being able to effectively use the protective sleeve. Without prototype testing of protective sleeve 100, it is not readily apparent how a typical ten inch wide by eight foot long filled water tube 150, weighing nearly 50 pounds, would be inserted into the protective sleeve 100 by only one person because of the cumbersome heavy weight of the filled water tube, nor is it apparent how a typical ten inch wide by eight foot long empty and weightless water tube 150 would be completely inserted into the protective sleeve 100 without the water tube first becoming bunched-up and stuck together, due to friction, with panels 101 and 102 of protective sleeve 100.

In the insertion method shown in FIG. 3, water tube 150 vinyl chambers 151 and 152 can first be partially pre-filled with water from a garden hose in order to give the water tube 150 some weight at the end opposite of openings 153 and 154 shown in FIG. 1. The weight needed from the initial pre-filling only needs to be about five pounds provided by approximately thirty-two ounces of water in each chamber 151 and 152. The approximate thirty-two ounces of water in each chamber 151 and 152 is shown as item 300 in FIG. 3. When the water tube 150 weighs about five pounds after the initial pre-filling, the user can hold open the open end 106 with one hand, and with the other hand, easily insert water tube 150 into protective sleeve 100 without any bunching up and sticking together of the water tube 150 and protective sleeve 100. After the partially filled water tube 150 is completely inserted into protective sleeve 100, the user can then continue to fill the chambers 151 and 152 as required and lastly seal the open end 106 using sealing apparatus 207.

Figure 4:
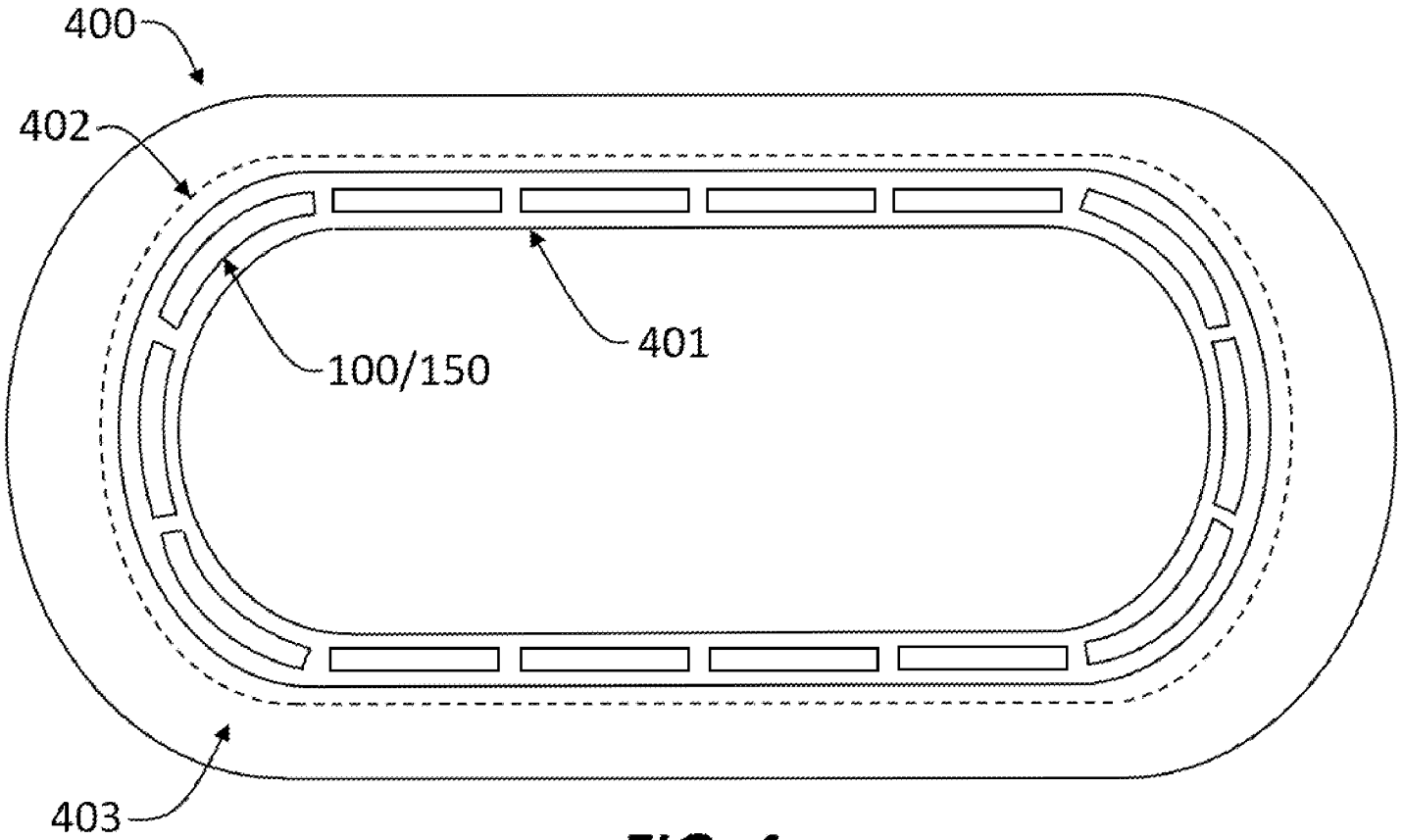
FIG. 4 is a plan view showing a typical oval shaped in-ground swimming pool with surrounding decking and a pool cover installed. Also in the figure are multiple water tube weights inserted into protective sleeves and placed end to end around the perimeter of the pool.

FIG. 4 is a plan view of a typical oval shaped in-ground swimming pool with surrounding decking. This figure includes components that were previously introduced in FIG. 1. Those components previously introduced that have not changed in this example retain their original element numbers and are not re-introduced. The purpose of FIG. 4 is to show how the protective sleeve 100, along with the filled and inserted water tube 150 would be placed end to end along the pool perimeter 401 to hold-down a typical swimming pool cover 402 shown as a dashed line in the figure for clarity. A swimming pool cover 402 is typically a large vinyl or weather resistant fabric tarp that is rectangular in shape but can be folded around the pool perimeter to better match the shape of an oval or free form pool. In the figure, fourteen protective sleeves 100 along with filled and inserted water tubes 150 are shown. The quantity could be more or less than fourteen depending on the size and shape of the pool. FIG. 4 illustrates why the long time commercially available vinyl water tubes 150 have proven to be an effective weight for holding down a pool cover 402 due to their ability to bend and conform to pools that are oval or any free form shape. In addition, they are typically made from vinyl tubing which makes them relatively low cost to manufacture and sell. Therefore, by inserting water tubes 150 into protective sleeve 100, the user will be protecting the water tubes from unfavorable outdoor elements such as dirt, grime, bird droppings, etc. They will also be adding extra protection against the water tubes from being torn or punctured when dragged or moved around wood, paver or concrete pool decking 403.

Figure 5:
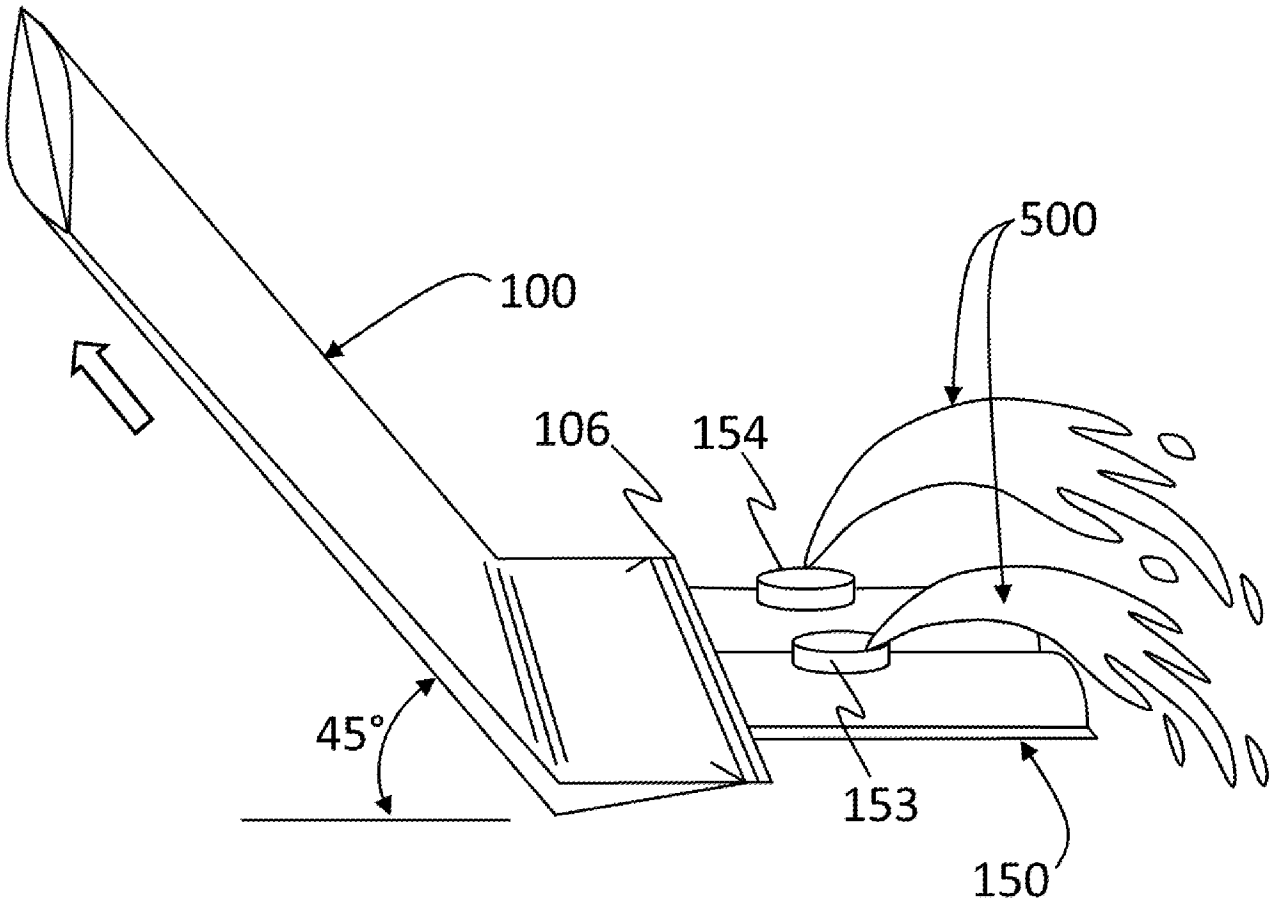
FIG. 5 is a perspective view showing a protective sleeve being removed from a swimming pool cover water tube weight.

FIG. 5 is a perspective view showing the removal method of protective sleeve 100 away from water tube 150. This figure includes components that were previously introduced in FIG. 1 and FIG. 2. Those components previously introduced that have not changed in this example retain their original element numbers and are not re-introduced. Based on prototype testing of protective sleeve 100, a method is shown how the removal of the protective sleeve 100 can be accomplished by one person.

Without prototype testing of protective sleeve 100, it's not readily apparent how protective sleeve 100 would be removed from a typical ten inch wide by eight foot long filled water tube 150, weighing nearly 50 pounds, by only one person because of the cumbersome heavy weight of the filled water tube. In this example, the openable end 106 of protective sleeve 100 can first be opened and partially pulled back exposing the water tube openings 153 and 154. Next, the attached caps of the openings are removed. Then, the opposite end of both the water tube 150 and protective sleeve 100 can be held up by one person at an angle approximately equal to forty-five degrees as shown in the figure. With the caps removed from water tube openings 153 and 154, and the opposite end of the water tube 150 and protective sleeve 100 held up at approximately forty-five degrees, the water inside the water tube will eject out openings 153 and 154. The ejected water is shown as item 500 in the figure. When the water tube 150 is approximately ninety percent empty, the protective sleeve 100 can be easily removed by the user and disposed of by recycling. The clean and still in like-new condition water tube 150 can then be folded and stored for use again later, thus saving the user from having to laboriously clean the water tubes or purchase new ones that might have been otherwise torn or punctured without the use of protective sleeve 100.

It will be apparent to one with skill in the art that the present invention may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be alterations made in the descriptions without departing from the spirit and scope of the present invention.

What is claimed is:

1. A protected swimming pool cover hold-down weight water tube assembly comprising:

(a) a single or double chamber elongated water tube weight with at least one resealable opening in proximity to one shorter side edge; and (b) a protective sleeve comprising a rectangular upper and lower panel made of recyclable material resistant to sub-freezing temperatures and direct sunlight permanently sealed together along both parallel long side edges and one perpendicular short side edge; an open short side edge for insertion/extraction of said water tube weight; the long sides being four to twenty-five percent longer and the perpendicular short sides being five to forty-five percent wider than said water tube weight; a closure device for sealing the open short side edge.

2. The protected water tube weight of claim 1 wherein said protective sleeve rectangular panels are in the range of 0.0005 to 0.006 inches thick.

3. The protected water tube weight of claim 1 wherein said protective sleeve comprises polyethylene.

4. The protected water tube weight of claim 1 wherein said protective sleeve comprises a cable tie or press-to-close zipper for sealing the open short side edge.

* * * * *